United States Patent [19]

Gringer

[11] 4,005,525

[45] Feb. 1, 1977

[54] RETRACTABLE CUTTING IMPLEMENT

[75] Inventor: Donald Gringer, Bedford, N.Y.

[73] Assignee: Allway Tools Inc., Bronx, N.Y.

[22] Filed: Aug. 29, 1975

[21] Appl. No.: 608,971

[52] U.S. Cl. ..... 30/125; 30/162; 30/320; 30/331; 30/335

[51] Int. Cl.[2] ..... B26B 1/08; B26B 5/00

[58] Field of Search ..... 30/162, 125, 320, 321, 30/330, 331, 335

[56] References Cited

UNITED STATES PATENTS

| | | | |
|---|---|---|---|
| 1,434,388 | 11/1922 | Hughes | 30/162 X |
| 1,906,573 | 5/1933 | Gits | 30/162 X |
| 2,245,096 | 6/1941 | Penney | 30/151 X |
| 2,820,293 | 1/1958 | Seldon | 30/125 X |
| 3,063,147 | 11/1962 | Paparelli | 30/320 X |
| 3,171,201 | 3/1965 | Carifi | 30/162 X |
| 3,316,635 | 5/1967 | Merrow et al. | 30/162 |
| 3,453,729 | 7/1969 | Larson | 30/162 |
| 3,604,113 | 9/1971 | Cuscovitch | 30/337 |
| 3,879,847 | 4/1975 | Roll | 30/162 |
| 3,906,625 | 9/1975 | Gringer | 30/125 |

*Primary Examiner*—Al Lawrence Smith
*Assistant Examiner*—J. T. Zatarga
*Attorney, Agent, or Firm*—Hubbell, Cohen, Stiefel & Gross

[57] ABSTRACT

A retractable cutting implement, such as a utility knife, comprises a sleeve-like handle member having a cavity portion with the handle member being open at the base and at one end through a first longitudinal slot. A carrier member is pivotally mounted to the handle for pivotal movement into and out of the cavity with the carrier member being resiliently held within the cavity when it is pivotally moved into the cavity for substantially closing the cavity. The carrier member comprises a substantially enclosed longitudinally extending chamber with a passage therein in communication with the one end of the first slot in the handle member and a blade carriage member is slidably mountable in this chamber for slidable movement toward and away from the passage. The blade carriage member has a plurality of studs at the end thereof opposite the pivotally mounted end of the carrier member adapted to support a perforated cutting blade having a top edge and a bottom edge for slidable movement of the blade into and out of the first slot one end through the passage when the implement is in the closed position. The carrier member includes an outer edge having a guide channel portion which is disposed on the carrier for protecting a portion of the cutting edge of the blade when the blade is supported on the studs. The handle member has a second longitudinal slit therein with a button disposed on the blade carriage member and extending through the chamber and into this slit in the closed position of the implement. The button is movable along the slit to effectuate movement of the blade carriage member to extend or retract the blade from the knife. The carrier further includes a resilient clip portion adapted to store and resiliently hold perforated cutting blade replacements for the supported blade with the resilient clip being pivotally insertable within the handle. The carrier, the handle and the blade carriage member are all preferably composed of metal, such as steel.

18 Claims, 16 Drawing Figures

RETRACTABLE CUTTING IMPLEMENT

CROSS-REFERENCE TO RELATED APPLICATIONS

This application is related to my co-pending U.S. patent application, Ser. No. 516,456, filed Oct. 21, 1974 and entitled "Cutting Implement", now U.S. Pat. No. 3,906,625.

BACKGROUND OF THE INVENTION

1. Field of the Invention

The present invention relates to cutting implements and particularly knives of the type having a retractable blade which is also removable from the handle.

2. Description of the Prior Art

Cutting implements, such as utility knives of the type in which the cutting blade is removable from the handle are well known, the combination of knife blade and handle being typically referred to as a utility knife. Such utility knives are normally available both with retractable blades, such as the type described in U.S. Pat. No. 3,192,624, and with non-retractable blades. Generally, such prior art utility knives comprise the type where two separate complimentary halves are secured together by a nut and bolt, such as the type of utility knife manufactured by Stanley Model No. 299, or the type disclosed in U.S. Pat. Nos. 2,376,887; 2,862,296; 2,948,961; 3,062,147; 3,107,426; or 3,192,624. Other prior art utility knives of the non-retractable type have been utilized which have a separate carrier member which pivots into and out of a handle, such as the type disclosed in U.S. Pat. No. 2,245,096. However, such a prior art pivotal arrangement does not have any provision for storage of replacement blades nor is there any provision for protecting a portion of the cutting edge. The previously mentioned type of prior art utility knives in which two separable halves are utilized provides for storage of replacement blades within the handle housing; however, there is no means for securing these blades within the housing and they rattle around in the knife during storage and often get dull before these blades have had an opportunity to be utilized. In addition, such prior art knives are usually formed of die cast housings with a screw to hold the handle together with the result that pressure on the blade during the cutting causes the two halves to have a tendency to separate and become a hazard. Furthermore, in several of these prior art utility knives having separate halves, only a portion of the cutting edge protrudes beyond the housing, such as where such a cutting blade is reversible to use the remaining portion to cut when the protruding portion becomes dull. However, the reverse edge which remains in the housing has a tendency to bear against the metal of the housing when pressure is applied to the cutting edge so that this unused edge is often dulled prior to reversal of the blade. Thus, prior art utility knives of which the applicant is presently aware are unsatisfactory in that they invariably require a tool of some sort, most typically, a screwdriver to gain access to the interior of the knife to take out replacement blades or to mount blades for cutting or, in the instance of the aforementioned prior art pivotal arrangement, replacement blades must be separately carried. The former is somewhat tedious and time consuming for the user as well as often resulting in dulled replacement blades from their rattling around within the housing during storage and the latter is somewhat inconvenient to the user. These disadvantages of the prior art are overcome by the present invention.

SUMMARY OF THE INVENTION

A retractable cutting implement is provided which comprises a sleeve-like handle member, a carrier member which is pivotally mounted to the handle member for pivotal movement into and out of a cavity portion within the handle, and a blade carriage member which is slidably mounted in the carrier member for slidable movement into and out of the handle member in the closed position of the implement. The cavity portion in the handle member comprises a first longitudinal slot with the handle being open on the base thereof through the first slot and at one end of the first slot. The carrier is pivotally mounted to the handle at the other end thereof opposite from the one end for enabling pivotal movement into and out of the cavity portion between a closed position and an open position for the cutting implement. The carrier resiliently holds within the cavity portion when the carrier is pivotally moved into the cavity portion for substantially closing the cavity portion. The carrier has a longitudinal extent substantially equivalent to the handle longitudinal extent and comprises a substantially enclosed longitudinally extending chamber with a passage therein in communication with the one end of the first slot in the handle. The blade carriage member is slidably movable toward and away from the passage and has a plurality of studs at the end thereof opposite the pivotally mounted end of the carrier adapted to support a perforated cutting blade having a top edge and a bottom edge for slidable movement of the blade into and out of the first slot one end through the passage when the implement is in the closed position. At least one of the blade edges comprises a cutting edge. The carrier member opposite end has an inner edge completely pivotally insertable within the handle member cavity portion first longitudinal slot and an outer edge, with the outer edge having a guide channel portion and being disposed on the carrier for protecting a portion of the cutting edge of the cutting blade when the cutting blade is supported on the blade carriage member studs. These studs are disposed on the blade carriage member for supporting the cutting blade in a first cutting position in a first slidable position of the blade carriage member with at least a portion of the cutting edge protruding through the first longitudinal slot one end beyond the handle member cavity portion when the cavity portion is substantially closed by the carrier member pivotal movement into the cavity portion and with the remaining portion of the cutting edge being within the guide channel portion. The handle member first longitudinal slot portion together with the carrier member guide channel portion forms a protective housing for the cutting blade remaining portion to protect the cutting blade top and bottom edges in the first cutting position. The handle member has a second longitudinal slit therein with a button being disposed on the blade carriage member and extending through the chamber and into the second longitudinal slit in the closed position of the cutting implement. The button is movable along the second slit when the blade carriage member slides within the chamber, the movement of the button effectuating the slidable movement of the blade carriage member. The second slit has a longitudinal extent sufficient to enable the slidable movement of the supported cutting blade between the first cutting position and a second retracted position of the cutting blade within the cutting implement. The cutting edge of the blade is enclosed within the cutting implement in the retracted position with the cutting implement in the closed position thereof, whereby the remaining portion of the cutting edge of the supported cutting blade is substantially prevented from dulling in the first cutting position and the entire cutting edge of the supported blade is protected in the retracted position.

The blade carriage member comprises a simple beam of resilient material with the button being disposed on the beam. The cutting implement further comprises means for supporting the beam at both ends thereof with the beam being deflectable between the supporting means in a given plane. The blade is detachably secured to the carriage member in a plane that is parallel to the given plane of deflection of the beam. Detent means are associated with the carriage member and the carrier member for releasably holding the carriage member against sliding movement with the detent means being released when the resilient beam is deflected. The second longitudinal slit, which is preferably disposed in the handle member substantially normal to the first longitudinal slot, preferably has a peripherally surrounding chamfered lip engageable with the button during the pivotal movement of the carrier member into the handle member during closure of the implement for initially depressing the button by resilient deflection of the beam during closure to enable completion of such closure while enabling the button to return and protrude into the second longitudinal slit for slidable movement therein after completion of such closure.

Preferably, the perforated supported cutting blade may be rotated 180 degrees from its initial position so as to be reversibly supported on the studs with the previously exposed portion now being in the guide channel and the portion previously disposed in the guide channel now being the protruding portion utilized for cutting, the cutting edge portion in the guide channel thereby being a reserve cutting edge for use in a second cutting position. The carrier is preferably formed with a resilient clip portion adapted to store and resiliently fixedly hold perforated cutting blade replacements for the supported cutting blade, the resilient portion being pivotally insertable within the handle when the cavity is substantially closed, whereby replacement blades are substantially prevented from movement during storage thereof in the cutting implement. The resilient clip portion also further comprises means for resiliently holding the carrier member within the cavity portion of the handle.

Preferably, the handle member, carrier member and blade carriage member are all made of a common material, such as preferably metal, such as preferably steel, with the blade carriage member being comprised of spring steel.

DETAILED DESCRIPTION OF THE PREFERRED EMBODIMENT

Figures 1, 2, 5, 6, 14:
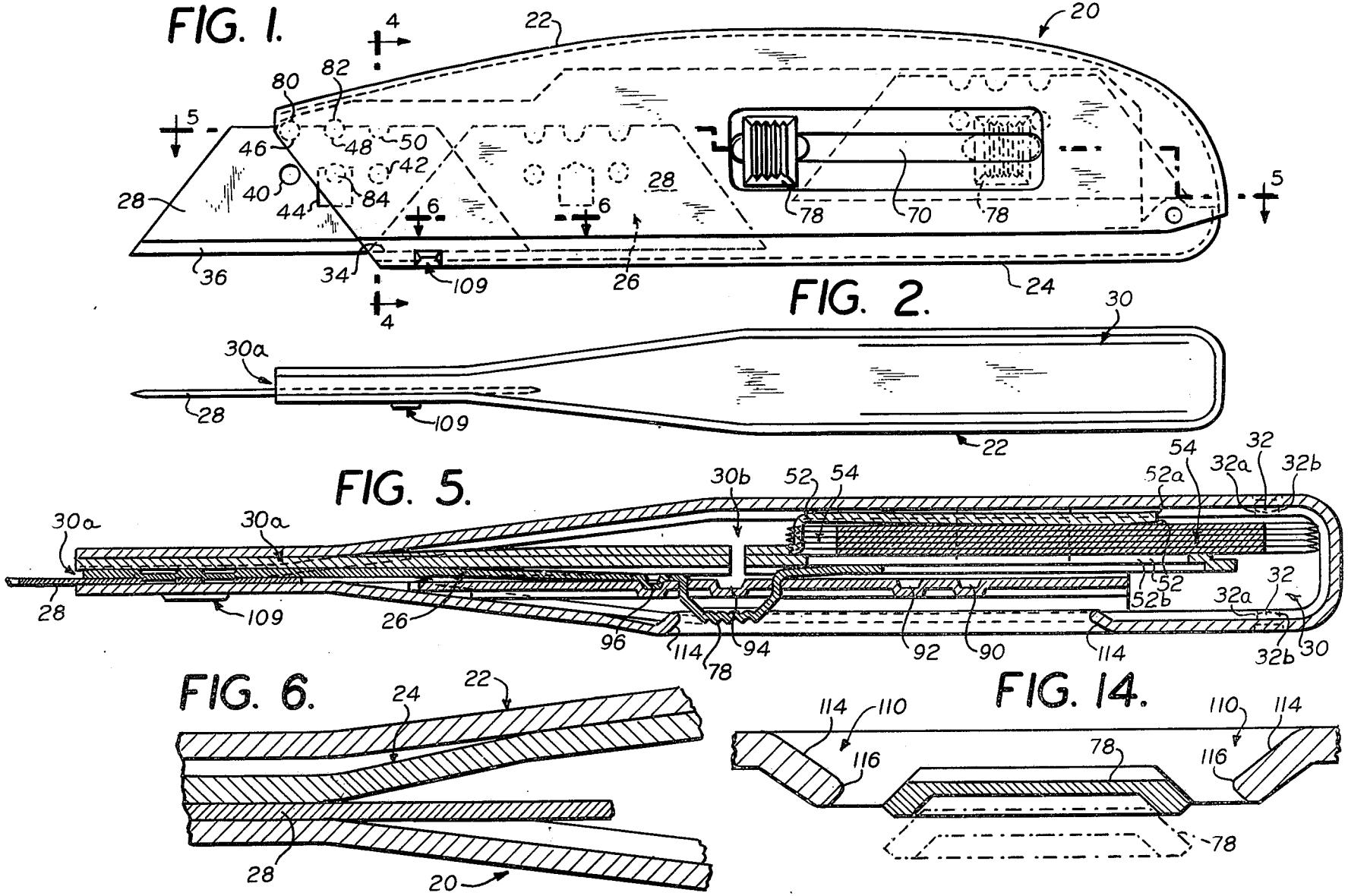
FIG. 1 is a side elevation view of the preferred retractable cutting implement of the present invention shown in the closed position.
FIG. 2 is a plan view of the embodiment illustrated in FIG. 1.
FIG. 5 is a plan view, in section, taken along line 5—5 of FIG. 1 of the embodiment illustrated in FIG. 1.
FIG. 6 is a fragmentary plan view, in section, taken along line 6—6 of FIG. 1 of the embodiment illustrated in FIG. 1.
FIG. 14 is an enlarged fragmentary rear elevation of the embodiment illustrated in FIG. 1.
Figure 3:
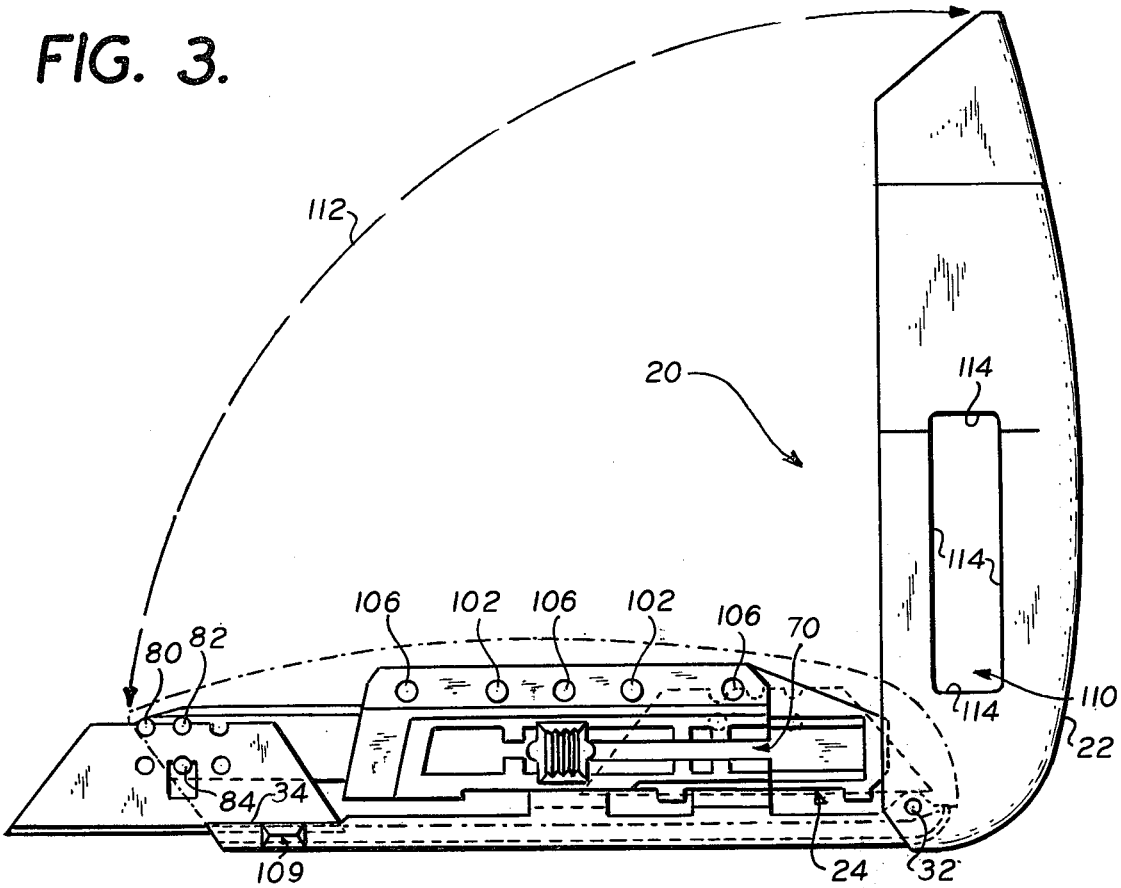
FIG. 3 is a side elevation of the embodiment illustrated in FIG. 1 with the retractable cutting implement in the open position.
Figure 4:
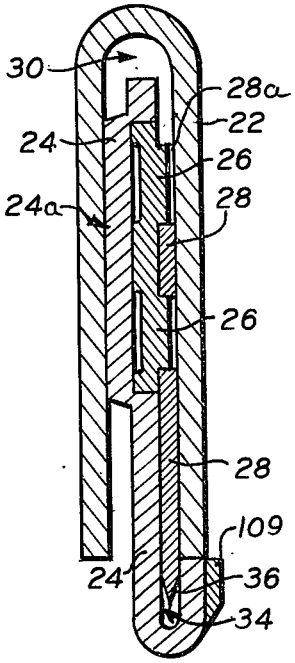
FIG. 4 is a front elevation, in section, taken along line 4—4 of FIG. 1, of the embodiment illustrated in FIG. 1.
Figure 10:
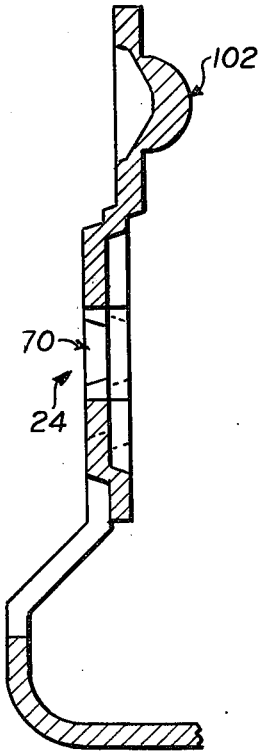
FIG. 10 is a rear elevation, in section, taken along line 10—10 of the embodiment illustrated in FIG. 8.
Figure 11:
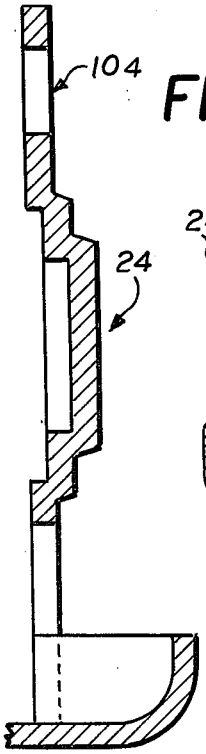
FIG. 11 is a rear elevation, in section, taken along line 11—11 of the embodiment illustrated in FIG. 9.

Referring now to the drawings in detail and initially to FIGS. 1, 3 and 5, the preferred embodiment of the retractable cutting implement of the present invention, which is generally referred to as a utility knife, generally referred to by the reference numberal 20, is shown. The retractable cutting implement or utility knife 20, which is preferably completely composed of metal, such as steel, although other materials, if desired, such as plastics, could be utilized, apart from the cutting blade to be described in greater detail hereinafter, preferably consists of three pieces, one piece being a sleeve-like handle 22, a second piece being a carrier member 24, and a third piece being a blade carriage member 26 (see FIGS. 7 and 15) which, as will be described in greater detail hereinafter, includes means for mounting the cutting blade in the knife 20. The carrier 24 which, as will be described in greater detail hereinafter, includes means for securely holding replacement blades, includes means for slidably mounting the blade carriage member 26 therein for enabling slidable movement of the mounted cutting blade into and out of the knife 20 in the closed position thereof so as to protect the entire cutting edge of the supported cutting blade in the retracted position thereof which retracted position is illustrated by the dotted lines of the blade 28 in FIG. 1. As shown and preferred in FIGS. 2, 4, 5 and 6, the handle 22 preferably is a hollow handle having a cavity portion 30 in which the carrier 24 and slidably mounted blade carriage member 26 can be situated when the knife 20 is in the closed position illustrated in FIG. 1, the carrier 24 substantially closing this cavity 30 in this position as illustrated in FIG. 4. As shown and preferred in FIG. 5, the handle 22 cavity portion 30 preferably includes a longitudinal slot **30*a*** towards the front of the handle 22 which, as will be described in greater detail hereinafter, is the portion through which the cutting blade being utilized with the knife 20 in the closed position of FIGS. 1, 4 and 5 passes into and out of the knife 20 during retraction and extension of the blade respectively, and a tapered portion 30*b* which tapers outwardly from the longitudinal slot 30*a* toward the rear of the knife 20. As is also shown and preferred in FIG. 5, the handle 22 is preferably secured to the carrier member 24 by a dimpled hinge 32 located towards the rear of the knife 20 which provides a pivotal connection between the handle 22 and the carrier member 24 so as to enable the carrier member 24 to pivot into and out of the cavity portion 30 of the handle 22 between the closed position illustrated in FIG. 1 and the open position illustrated in FIG. 3. The dimpled hinge 32 is preferably a conventional type of connection and will not be described in greater detail hereinafter other than to say that it comprises a protrusion 32*a* on the interior of the handle 22 which nests in a slot 32*b* in the carrier member 24. It should be noted that, as will be described in greater detail hereinafter, the blade carriage member 26 is preferably slidably mounted on the carrier member 24 before pivotal connection of the handle 22 to the carrier 24 with the blade carriage member 26 preferably being initially slidably insertable in the carrier 24 from the rear thereof before pivotally connecting the handle 22 to the carrier member 24.

As shown and preferred in FIGS. 1, 2, 3 and 5, the longitudinal extent of the carrier 24 in which the blade carriage member 26 is slidably mounted is substantially equivalent to the longitudinal extent of the handle 22 and is nestable therein in the closed position, such as illustrated in FIGS. 1 and 4, except for the guide channel 34 to be described in greater detail hereinafter, the handle 22 and the carrier 24 in the closed position preferably forming a substantially continuous peripheral outline as illustrated in FIGS. 1 and 4 and substantially enclosing the blade carriage member 26 within the chamber so formed so as to enable slidable movement within the chamber for the blade carriage member and, consequently, for the cutting blade supported thereon. Thus, as shown in FIG. 4, the carrier 24 preferably has a guide channel 34 at the base thereof, the guide channel 34 primarily being for protection of the portion of the cutting edge 36 of blade 28 (FIG. 16) which is not presently being utilized for cutting so as to prevent the reserve edge, which is what this portion is termed since when the blade 28 is rotated 180° this edge becomes the cutting edge, from dulling against the handle. This cutting edge 36 reserve portion is thereby protected in the guide channel 34 and any tendency for the handle 22 and carrier 24 to separate during cutting when normal cutting pressure is applied is thereby minimized. In addition, the cutting blade 28 is preferably wrapped around the top 28*a* and bottom, or in this instance cutting edge 36, in order to completely protect the reserve portion of the blade 28 as well as to minimize any tendency of the handle 22 and carrier 24 to split apart. Furthermore, as shown and preferred in FIG. 4, the blade carriage member 26 is completely contained within a chamber formed by handle 22 and carrier 24 in the closed position of the knife 20 with the carriage member 26 being slidable into and out of this chamber through the passage formed by the longitudinal slot 30*a* and the slidable mounting of the carriage member 26 in the carrier 24. This arrangement shall be described in greater detail hereinafer with reference to FIG. 5.

Figures 7, 8, 9, 15, 16:
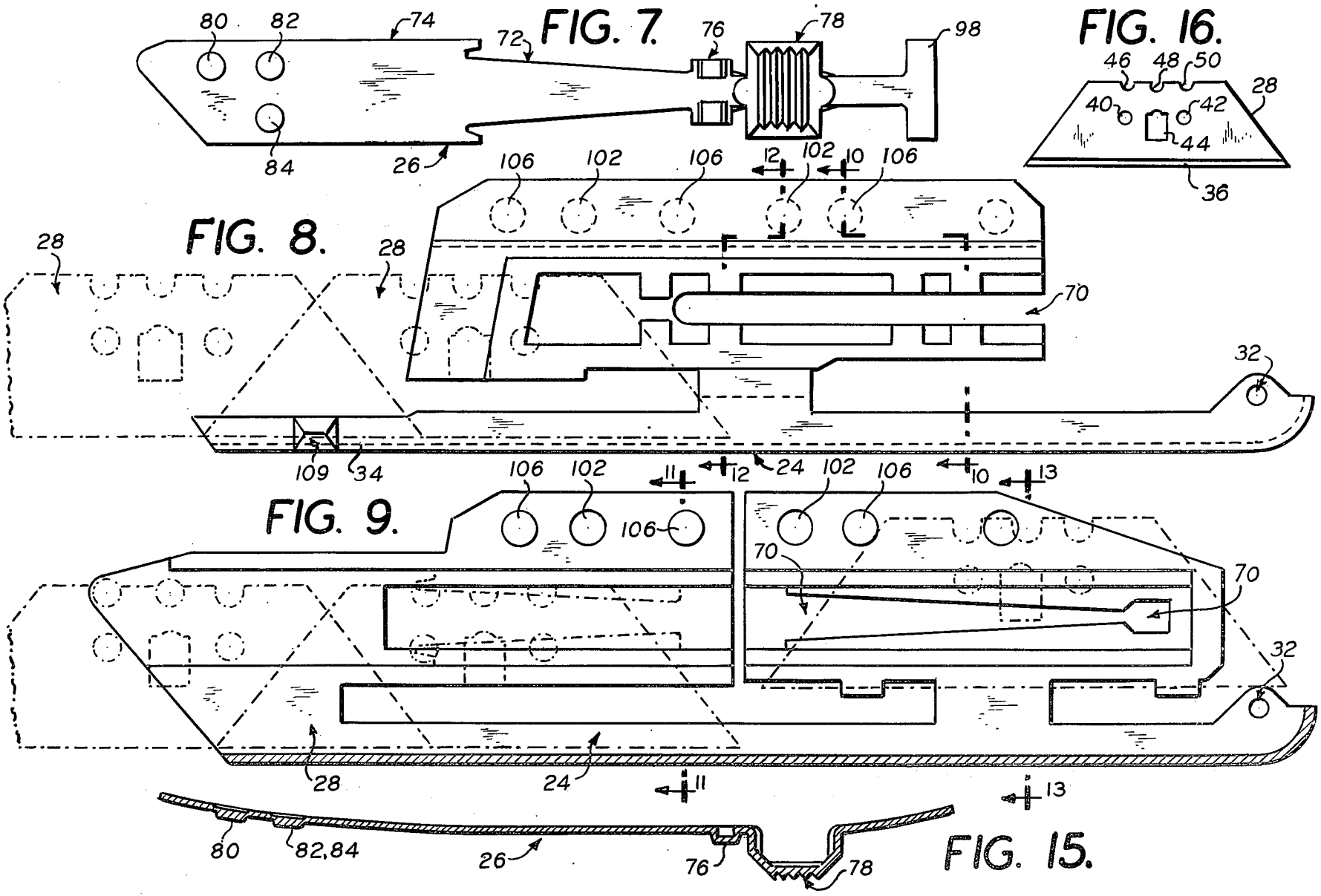
FIG. 7 is a side elevation of the blade carriage member portion of the embodiment illustrated in FIG. 1.
FIG. 8 is a side elevation of the carrier member of the embodiment illustrated in FIG. 1 taken from the left side thereof.
FIG. 9 is a side elevation, similar to FIG. 8, of the carrier member of the embodiment illustrated in FIG. 1 taken from the right side thereof.
FIG. 15 is a plan view of the blade carriage member illustrated in FIG. 7.
FIG. 16 is a side elevation of a typical preferred blade for use with the preferred retractable cutting implement illustrated in FIG. 1.

As shown and preferred in FIG. 16, a typical cutting blade 28 for use with the knife 20 of the present invention is shown, the blade 28 preferably being a conventional symmetrical blade having the cutting edge 36 at the bottom thereof and having mounting holes or apertures 40 and 42 and a mounting slot 44 within the interior of the blade 28 and semi-circular notches 46, 48 and 50 in the top edge 28*a* of the blade 28 for mounting the blade 28 in a desired cutting position carriage member 26, as illustrated in FIGS. 1, 3 and 7, the blade 28 therefore being termed a perforated cutting blade. The carrier 24, which preferably comprises an integral structure with the blade carriage member 26 being a separate structure slidably mounted therein, preferably has a resilient clip portion 52 for holding replacement blades 54 identical with the blade 28 illustrated in FIG. 16, by way for example, for the cutting blade being utilized. The resilient clip portion 52 may preferably be termed a self-spring whose resiliency is sufficient to prevent these replacement or reserve blades 54 from rattling while being fixedly resiliently held therein, such as illustrated in FIG. 5. The replacement blades 54 are preferably forceably inserted between the guide portions 52*a* and 52*b* comprising the resilient clip 52 to spread these portions apart which then resiliently spring back to resiliently fixedly hold the replacement blade or blades 54 between the side portions 52*a* and 52*b* of the resilient clip 52. Although five such replacement blades 54 are illustrated in FIG. 5, any desired number of replacement blades, determined by the resiliency of clip 52 and the physical dimensions of the blade and knife handle cavity may be utilized and, most preferably, a plurality of such replacement blades are normally intended to be resiliently held within clip 52 for storage.

Referring now to FIGS. 5 through 15, and initially to FIGS. 7 and 15, the blade carriage member 26 of the present invention shall be described in greater detail. The blade carriage member 26 is preferably slidably mountable in a longitudinal or axial slit 70 formed in the sides of the carrier 24 (FIGS. 8 and 9) by means of a slider portion 72 which extends longitudinally from a blade support portion 74 and is preferably integral therewith. The slider portion 72, as shown and preferred in FIGS. 7 and 15, as well as in FIG. 5, preferably includes a detent or stop member 76 and a button 78 for effectuating sliding movement of the blade carriage 26 within knife 20 so as to extend and retract the supported blade 28. The blade support portion 74 of carriage 26 preferably includes a plurality of mounting studs, three such studs 80, 82 ad 84 being shown by way of example, which are preferably adapted to support the perforated cutting blade 28 thereon in a cutting position for slidable movement into and out of the knife 20 in the closed position thereof as illustrated in FIG. 1. As shown and preferred in FIGS. 1, 3, 4, 8 and 9 the cutting blade 28 preferably has a rearward cutting position which is obtained by mounting the perforated cutting blade 28 so that stud 84 protrudes through mounting slot 44 and studs 80 and 82 nest in notches 46 and 48, respectively, and a forward cutting position in which stud 84 nests in aperture 42 and studs 80 and 82 nest in notches 48 and 50, respectively. As shown and preferred, in both the rearward and forward position, the blade 28 is supported on the carriage member 26 at only three points, the locations of the studs 80, 82 and 84, with additional support being provided by guide channel 34 in which the blade 28 cutting edge 36 slides as illustrated in FIGS. 8 and 9. As previously mentioned, the blade carriage member 26 is preferably not removable from the knife 20 after initial insertion in the carrier 24 from the rear thereof and subsequent pivotal mounting of the handle 22 to the carrier 24. Furthermore, the blade 28 is preferably only held on the three studs 80, 82 and 84, which prevent shifting of the blade, in place of resting on a foot as in a conventional retractable knife such as the type described in U.S. Pat. No. 3,192,624. In the mounted position of the blade 28 as shown and preferred in FIGS. 1 and 3, in both the forward and rearward cutting positions, the portion of the cutting edge 36 which does not protrude beyond the handle 22, previously referred to as the reserve edge, is situated in the guide channel 34 of the carrier 24 and, in the fully retracted position of the cutting edge 36 or blade 28, this cutting edge 36 is completely situated in the guide channel 34 so that the cuttting edge 36 preferably does not extend outside the handle 22 in the fully retracted position. Thus, as previously mentioned, the handle 22 and carrier 24 in the closed position of the knife illustrated in FIGS. 1 and 4 form an enclosed passage or chamber for slidable movement of the supported blade 28 on the blade carriage member 26 therein to extend the blade 28 out of the handle 22 for cutting and retract it within the handle 22 for safety when the knife is not being used.

Figure 12:
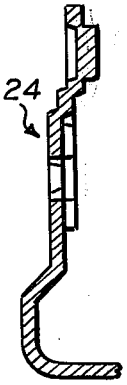
FIG. 12 is a rear elevation, in section, taken along line 12—12 of the embodiment illustrated in FIG. 8.
Figure 13:
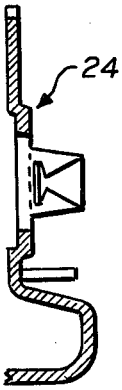
FIG. 13 is a rear elevation, in section, taken along line 13—13 of FIG. 9 of the embodiment illustrated in FIG. 1.

As shown and preferred in FIGS. 5 and 15, the blade carriage member 26 is preferably made of a resilient spring steel which is preferably pre-bent before inserting the carriage member 26 in the knife 20 during assembly thereof so as to enhance the resiliency thereof as illustrated in FIG. 15. Also, preferably, the handle 22 and the carrier 26 are formed of steel. As shown and preferred in FIGS. 5, 7 and 15, detent 76 which extends from the side of the carriage member 26 is selectively seatable or nestable in indent 90, 92, 94 or 96 located in carrier 24 depending on the axial or longitudinal position of the slidably movable blade carriage member 26. Thus, as clearly shown in FIG. 5, by depressing button 78 and urging it axially, detent 76 is moved downwardly out of the indent 90, 92, 94 or 96 in which it is situated by the deflection of a resilient body 26 and the carriage member 26 is free to ride within the slot 70 to a new position carrying the supported blade 28 with it. The deflection in carriage member 26 primarily occurs in the slider portion 72 with the portion 74 which supports the blade 28 preferably being more rigid than slider portion 72 of carriage member 26 which portion 72 is more readily deflectable. By virture of the foregoing construction, the carriage member 26 preferably comprises a simple beam member which is supported on both ends by means of T shaped connection 98 and the slidable mounting of portions 72–74 in a track within carrier 24 as illustrated in FIGS. 2, 12 and 13, which is deflectable by a force acting substantially perpendicular to the beam axis. This simple-beam type carriage member 26 is readily deflected by applying pressure to the button 78, which button 78 is preferably also steel, the carriage member 26 preferably being formed in one piece as illustrated in FIG. 15, and when so deflected the carriage member 26 is readily moved axially of the knife to whatever position desired. As shown and preferred in FIG. 4, the carrier 24 peripheral configuration is preferably arranged so that at least one point 24*a* therealong, the carrier 24 resiliently protrudes so as to assist in resiliently holding the carrier 24 within the handle 22 in the closed position of the knife 20. As shown and preferred in FIGS. 3, 8, 9, 10 and 11, the carrier 24 is preferably formed from a single piece of steel which is shaped or bent with the the top edges or extremities thereof (FIGS. 10 and 11) connected together due to pilots 102 or guides which are insertable in complimentary apertures 104 so as to align the two portions which are bent about the center line of the carrier 24 and which are secured together by rivets 106, three such rivets being illustrated in FIG. 3. In this manner, an enclosed channel or chamber for the slidable mounting of the carriage member 26 therein is formed. The carriage member 26 is then inserted in the carrier 24 through the rear thereof and the handle 22 is then pivotally mounted to the carrier 24 by the dimpled hinge arrangement 32 illustrated in FIG. 5.

Referring to FIGS. 1, 3, 5 and 14, the pivotal opening and closing of the knife 20 shall be described. As shown and preferred in FIGS. 1 through 5 and 8, the outside of the guide channel 34 of the carrier 24 preferably includes a protrusion 109 which provides a finger pull for assisting in applying finger pressure to the carrier 24, which, as was previously mentioned, is preferably resiliently held within the handle 22, to overcome this resilient force and pivot the knife 20 to the open position illustrated in FIG. 3 so that the cutting blade 28 may be replaced by a replacement blade 54 from the resilient clip 52 storage. In addition, as shown and prefered in FIGS. 1 and 3 which illustrate the closed and open position of the knife 20, respectively, a longitudinal slit 110 is preferably located in the side of the handle 22 and is, thus, normal to the open base of the handle 22. The location and extent of the slit 110 is preferably such so that when the knife 20 is in the closed position, as illustrated in FIG. 1, it registers with the slit 70 in which the button 78 slides so as to enable the full slidable movement of the button 78 within the slit 70 and, thus, effectuate slidable movement of the blade 28 into and out of the handle 22. Thus, slit 110 enables access to the button 78 by the user of the knife 20. In order to facilitate pivotal closure of the knife 20 by 90 degree rotation of the handle 22 as illustrated by the arrow 112 in FIG. 3 so as to place the knife in the closed position illustrated in FIG. 1, the slit 110 preferably has an inwardly chamfered peripherally surrounding lip 114 chamfered at a predetermined angle, such as preferably 35° with respect to a line parallel to the longitudinal axis of the handle 22, which chamfered edge is preferably rounded at the extremities 116 thereof for initially engaging the button 78 during such pivotal closure so as to initially resiliently depress the button 78 during such closure, after which button 78 then returns to its rest position extending into the slit 110 upon completion of such closure as illustrated in FIG. 1. The result of such initial engagement and depression is illustrated in FIG. 14 by the dotted lines for button 78.

It should be noted, although not shown that when it is desired to change or replace the blade 28 supported on the carriage member 26, the carriage member 26 is preferably slidably moved to the position in which indent 96, by way of example, is engaged by detent 76 thus extending the carriage member 26 out of the handle 22 or carrier 24 in which it is slidable mounted for a sufficient extent to enable removal of the mounted blade fromm studs 80, 82 and 84 and replacement of the blade 28 with another blade on the studs. Similarly, this position is also obtained if it is desired to change the cutting position of the blade 28 by rotating the blade 28 180° to utilize the previous reserve cutting edge 36 since the carriage member 26 is extended out of the carrier 24 for a sufficient distance so as to insure that the blade 28 in this replacement blade position no longer has the cutting edge 36 situated in the guide channel 34. Thereafer, the blade 28 is remounted on the studs 80, 82 and 84, with the reserve cutting edge which was previously contained in the guide channel 34 now becoming the exposed cutting edge and the previously exposed cutting edge now resting in the guide channel 34. When it is desired to replace the blade 28 with a blade from storage 54, the knife 20 is pivoted to the open position to gain access to the stored blades 54 which pivotal action can occur before or after the carriage member 26 is moved to the aforementioned position which enables changing or replacement of the blade.

By utilizing the retractable cutting implement or utility knife of the present invention, dulling of replacement blades during storage is minimized as is the dulling of the reserve edge of the cutting blade and, accordingly, a more efficient utility knife is provided and no special tools are required, such as a screwdriver, to open the utility knife for access to replacement blades.

I claim:

1. A retractable cutting implement comprising a sleeve-like handle member, said handle member having a cavity portion comprising a first longitudinal slot, said handle member being open on the base thereof through said first slot and at one end of said first slot; a carrier member pivotally mounted to said hollow sleeve-like handle member at the other end thereof opposite from said one end for pivotal movement into and out of said cavity portion between a closed position and an open position for said implement, said carrier member resiliently holding within said cavity carrier member when said carrier member is pivotally moved into said cavity portion for substantially closing said cavity portion, said carrier member having a longitudinal extent substantially equivalent to said handle member longitudinal extent and comprising a substantially enclosed longitudinally extending chamber with a passage therein in communication with said one end of said first slot in said handle member; and a blade carriage member slidably mountable in said carrier member chamber for slidable movement toward and away from said passage, said blade carriage member having a plurality of studs at the end thereof opposite said pivotally mounted end of said carrier adapted to support a perforated cutting blade having a top edge and a bottom edge for slidable movement of said blade into and out of said first slot one end through said passage when said implement is in said closed position, at least one of said blade edges comprising a cutting edge, said carrier member opposite end having an inner edge completely pivotally insertable within said handle member cavity portion first longitudinal slot and an outer edge, said outer edge having a guide channel portion and being disposed on said carrier member for protecting a portion of the cutting edge of said cutting blade when said cutting blade is supported on said blade carriage member studs, said studs being disposed on said blade carriage member for supporting said cutting blade in a first cutting position in a first slidable position of said blade carriage member with at least a portion of said cutting edge protruding through said first longitudinal slot one end beyond said handle member cavity portion when said cavity portion is substantially closed by said carrier member pivotal movement into said cavity portion and with the remaining portion of said cutting edge being within said guide channel portion, said handle member first longitudinal slot portion together with said carrier member guide channel portion forming a protective housing for said cutting blade remaining portion to protect said cutting blade top and bottom edges in said first cutting position, said handle member having a second longitudinal slit therein, a button being disposed on said blade carriage member and extending through said chamber and into said second longitudinal slit in said closed position of said implement with said button being movable along said second slit when said blade carriage member slides within said chamber, said movement of said button effectuating said slidable movement of said blade carriage member, said second slit having a longitudinal extent sufficient to enable said slidable movement of said supported cutting blade between said first cutting position and a second retracted position of said cutting blade within said cutting implement, said cutting edge being enclosed with said cutting implement in said retracted position with said implement in said closed position thereof, whereby the remaining portion of said cutting edge of said supported cutting blade is substantially prevented from dulling in said first cutting position and substantially the entire cutting edge of said supported blade is protected in said retracted position.

2. A retractable cutting implement in accordance with claim 1 wherein said cavity portion further comprises a tapered longitudinally extending cavity portion tapering outwardly towards said handle member other end from a narrow portion at said one end and being in communication with said slot at said narrow portion, said narrow portion being determined by said slot.

3. A retractable cutting implement in accordance with claim 1 wherein said channel guide portion further comprises a finger pull protrusion extending outside said cavity portion when said carrier member is pivotally inserted therein for facilitating pivotal movement of said pivotally inserted carrier member out of said handle member cavity portion.

4. A retractable cutting implement in accordance with claim 1 wherein said second longitudinal slit is disposed in said handle member substantially normal to said first longitudinal slot.

5. A retractable cutting implement in accordance with claim 4 wherein said second longitudinal slit has a peripherally surrounding chamfered lip engageable with said button during said pivotal movement of said carrier member into said handle member during closure of said implement for initially depressing said button during said closure to enable completion of said closure while enabling said button to protrude into said second longitudinal slit for slidable movement therein after completion of said closure.

6. A retractable cutting implement in accordance with claim 1 wherein said carrier member is further formed with a resilient clip portion adapted to store and resiliently fixedly hold perforated cutting blade replacements for said supported cutting blade, said resilient clip portion also being pivotally insertable within said handle member when said cavity portion is substantially closed, whereby replacement blades are substantially prevented from movement during storage thereof in said cutting implement.

7. A retractable cutting implement in accordance with claim 6 wherein said resilient clip portion further comprises means for resiliently holding said carrier member within said cavity portion.

8. A retractable cutting implement in accordance with claim 1 wherein said handle member, said carrier member and said blade carriage member are made of a common material.

9. A retractable cutting implement in accordance with claim 8 wherein said common material is metal.

10. A retractable cutting implement in accordance with claim 9 wherein said metal is steel.

11. A retractable cutting implement in accordance with claim 1 wherein said blade carriage member comprises a simple beam of resilient material with said button disposed on said beam; said cutting implement further comprising means for supporting said beam at both ends thereof, said beam being deflectable between said supporting means in a given plane, said blade being detachably secured to said carriage member in a plane that is parallel to said given plane of deflection of said beam, and detent means associated with said carriage member and said carrier member for releasably holding said carriage member against said sliding movement, said detent means being released when said resilient beam is deflected.

12. A retractable cutting implement in accordance with claim 11 wherein said second longitudinal slit is disposed in said handle member substantially normal to said first longitudinal slot.

13. A retractable cutting implement in accordance with claim 11 wherein said second longitudinal slit has a peripherally surrounding chamfered lip engageable with said button during said pivotal movement of said carrier member into said handle member during closure of said implement for initially depressing said button by resilient deflection of said beam during said closure to enable completion of said closure while enabling said button to protrude into said second longitudinal slit for slidable movement therein after completion of said closure.

14. A retractable cutting implement in accordance with claim 11 wherein said carrier member is further formed with a resilient clip portion adapted to store and resiliently fixedly hold perforated cutting blade replacements for said supported cutting blade, said resilient clip portion also being pivotally insertable within said handle member when said cavity portion is substantially closed, whereby replacement blades are substantially prevented from movement during storage thereof in said cutting implement.

15. A retractable cutting implement in accordance with claim 11 wherein said resilient material comprising said simple beam comprises spring steel.

16. A retractable cutting implement in accordance with claim 11 wherein said handle member, said carrier member and said blade carriage member are made of a common material.

17. A retractable cutting implement in accordance with claim 16 wherein said common material is metal.

18. A retractable cutting implement in accordance with claim 17 wherein said metal is steel.

* * * * *